US011858705B2

(12) United States Patent
Ormsbee et al.

(10) Patent No.: US 11,858,705 B2
(45) Date of Patent: Jan. 2, 2024

(54) SYSTEMS AND METHODS FOR AN IMPROVED STRAP INCLUDING AN END HOLDER

(71) Applicant: Nite Ize, Inc., Boulder, CO (US)

(72) Inventors: Bowden Ormsbee, Longmont, CO (US); Dale Karacostas, Boulder, CO (US)

(73) Assignee: Nite Ize, Inc., Boulder, CO (US)

( * ) Notice: Subject to any disclaimer, the term of this patent is extended or adjusted under 35 U.S.C. 154(b) by 0 days.

(21) Appl. No.: 17/647,105

(22) Filed: Jan. 5, 2022

(65) Prior Publication Data

US 2023/0211931 A1 Jul. 6, 2023

(51) Int. Cl.
*B65D 63/16* (2006.01)
*A44B 11/22* (2006.01)

(52) U.S. Cl.
CPC ..... *B65D 63/16* (2013.01); *A44B 11/22* (2013.01)

(58) Field of Classification Search
CPC ..... A44B 11/22; B65D 63/16; Y10T 24/406
See application file for complete search history.

(56) References Cited

U.S. PATENT DOCUMENTS 10,973,269 B2 * 4/2021 Moritz ..... A41F 9/00
2004/0231200 A1 11/2004 Forrest et al.
2005/0183291 A1 8/2005 Kiniry et al.
2018/0153289 A1 6/2018 Rose et al.
2019/0185094 A1 6/2019 Vogel et al.
2020/0078660 A1 3/2020 Keohane et al.
2021/0145129 A1 * 5/2021 Di Bartolo ..... A41F 9/002

FOREIGN PATENT DOCUMENTS

GB 2468945 A 9/2010

OTHER PUBLICATIONS

International Search Report and Written Opinion dated Oct. 13, 2022 issued in related PCT App. No. PCT/US2022/074008 (12 pages).
"Voile Straps—15" Nylon Buckle" (Voile) Aug. 13, 2020 (Aug. 13, 2020) [online] (retrieved from the internet on Sep. 15, 2022) <URL https://web.archive.org/web/20200813054055/https:l/www.voile.com/voile-straps-15-inch-nylon- buckle.h.tml>, entire document, especially p. 1, Figure 1; p. 2, Description.

* cited by examiner

*Primary Examiner* — Robert Sandy
(74) *Attorney, Agent, or Firm* — Haynes and Boone, LLP

(57) ABSTRACT

A strap system includes a strap, the strap including a plurality of apertures. The strap system further includes a buckle, the buckle located a first end of the strap, the buckle including an aperture and prong, the prong extending beyond the aperture, the prong sized to fit in each of the plurality of apertures. The strap system further includes a sliding holder, the sliding holder located on the strap, such that the sliding holder slides along the strap, the sliding holder including a projection, the projection extending from the sliding holder, the projection sized to fit into each of the plurality of apertures.

20 Claims, 4 Drawing Sheets

SYSTEMS AND METHODS FOR AN IMPROVED STRAP INCLUDING AN END HOLDER

BACKGROUND

In various scenarios, it is desirable to have a strap for holding and securing various objects. In many scenarios, users desire to bind skis or other items together. A strap that has some elasticity may be used and many times there is a loose end or other non-optimized feature. This may reduce the wear potential of the device and may be annoying to the user.

SUMMARY

In one embodiment, a strap system includes a strap, the strap including a plurality of apertures. The strap system further includes a buckle, the buckle located a first end of the strap, the buckle including an aperture and prong, the prong extending beyond the aperture, the prong sized to fit in each of the plurality of apertures. The strap system further includes a sliding holder, the sliding holder located on the strap, such that the sliding holder slides along the strap, the sliding holder including a projection, the projection extending from the sliding holder, the projection sized to fit into each of the plurality of apertures. Alternatively, the prong is bent towards a first side in relation to a plane through which the aperture extends. In one alternative, the strap has a released position where the strap is not secured in the buckle and a holding position where the strap is secured in the buckle by passing a second end of the strap through the aperture and folding the strap back towards the prong and placing the prong through a first one of the plurality of apertures. In another alternative, the holding position further includes placing the projection through a second one of the plurality of apertures, the second one of the plurality of apertures further towards the second end than the first one of the plurality of apertures. In another alternative, in the holding position the sliding holder is slid along the strap in order for the second one of the plurality of apertures to line up with the projection. Alternatively, the projection has a widened tip, such that projection has an interference fit in the second one of the plurality of apertures. In another alternative, sliding holder includes a ring with a loop, the loop sized to fit around the strap, such that loop is sized to smoothly slide on the strap. Alternatively, the buckle is fixed into the first end of the strap, such that the plane maintains an inline position with the first end of the strap. In another alternative, wherein when in the holding position, when the strap is tensioned tightly around an object, the buckle lays flat on the object. Alternatively, the strap includes an end tab on the second end of the strap. In another alternative, the end tab includes a depression configured for ease of gripping by a user. Alternatively, the strap is made of thermoplastic polyurethane.

In one embodiment, a strap system includes a strap, the strap including a plurality of apertures. The strap system further includes a buckle, the buckle located a first end of the strap, the buckle including an aperture and prong, the prong extending beyond the aperture, the prong sized to fit in each of the plurality of apertures. The strap system further includes a sliding holder, the sliding holder located on the strap, such that the sliding holder slides along the strap, the sliding holder including a projection, the projection extending from the sliding holder, the projection sized to fit into each of the plurality of apertures, wherein the strap includes an end tab on the second end of the strap and the end tab includes a depression configured for ease of gripping by a user. Alternatively, the prong is bent towards a first side in relation to a plane through which the aperture extends, the strap has a released position where the strap is not secured in the buckle and a holding position where the strap is secured in the buckle by passing a second end of the strap through the aperture and folding the strap back towards the prong and placing the prong through a first one of the plurality of apertures, holding position further includes placing the projection through a second one of the plurality of apertures, the second one of the plurality of apertures further towards the second end than the first one of the plurality of apertures, and the holding position the sliding holder is slid along the strap in order for the second one of the plurality of apertures to line up with the projection.

In one embodiment, a method of securing an object includes providing a strap system, the strap system. The strap system includes a strap, the strap including a plurality of apertures. The strap system further includes a buckle, the buckle located a first end of the strap, the buckle including an aperture and prong, the prong extending beyond the aperture, the prong sized to fit in each of the plurality of apertures. The strap system further includes a sliding holder, the sliding holder located on the strap, such that the sliding holder slides along the strap, the sliding holder including a projection, the projection extending from the sliding holder, the projection sized to fit into each of the plurality of apertures. The method further includes wrapping the strap around an object. The method further includes running a second end of the strap through the aperture. The method further includes pulling the strap tight around the object. The method further includes placing the prong in a first one of the plurality of apertures. The method further includes placing the projection in a second one of the plurality of apertures. Alternatively, the method further includes sliding the sliding holder along the strap in order to line up with the second one of the plurality or apertures, wherein the second one of the plurality of apertures is near the second end of the strap. Alternatively, the prong is bent towards a first side in relation to a plane through which the aperture extends, the strap has a released position where the strap is not secured in the buckle and a holding position where the strap is secured in the buckle by passing a second end of the strap through the aperture and folding the strap back towards the prong and placing the prong through a first one of the plurality of apertures, holding position further includes placing the projection through a second one of the plurality of apertures, the second one of the plurality of apertures further towards the second end than the first one of the plurality of apertures, and the holding position the sliding holder is slid along the strap in order for the second one of the plurality of apertures to line up with the projection. In another alternative, the projection has a widened tip, such that projection has an interference fit in the second one of the plurality of apertures, the sliding holder includes a ring with a loop, the loop sized to fit around the strap, such that loop is sized to smoothly slide on the strap, and the buckle is fixed into the first end of the strap, such that the plane maintains an inline position with the first end of the strap. Alternatively, the strap includes an end tab on the second end of the strap. In another alternative, the end tab includes a depression configured for ease of gripping by a user.

DETAILED DESCRIPTION

Certain terminology is used herein for convenience only and is not to be taken as a limitation on the embodiments of the systems and methods for an improved strap including end holder. In many embodiments a strap is provided that includes a buckle. The buckle has an aperture and a prong that bends one way. Since the buckle is fixed in line with the strap, upon tensioning around an item, the buckle lies in-line with the strap. This is way the prong, since it is bend up in relation to the plane of the aperture of the buckle, may mate with one of the holes in the strap and hold the strap in place. Additionally, the loose end of the strap may be attached to a sliding holder (end holder). This sliding holder includes a protrusion that fits in the holes of the strap and therefore may be slide to an optimal position. The sliding holder is advantageous since it is easy to lock down and release the end of the strap. The sliding holder is generally a ring-like structure that conforms to the shape of the strap.

Figure 1:
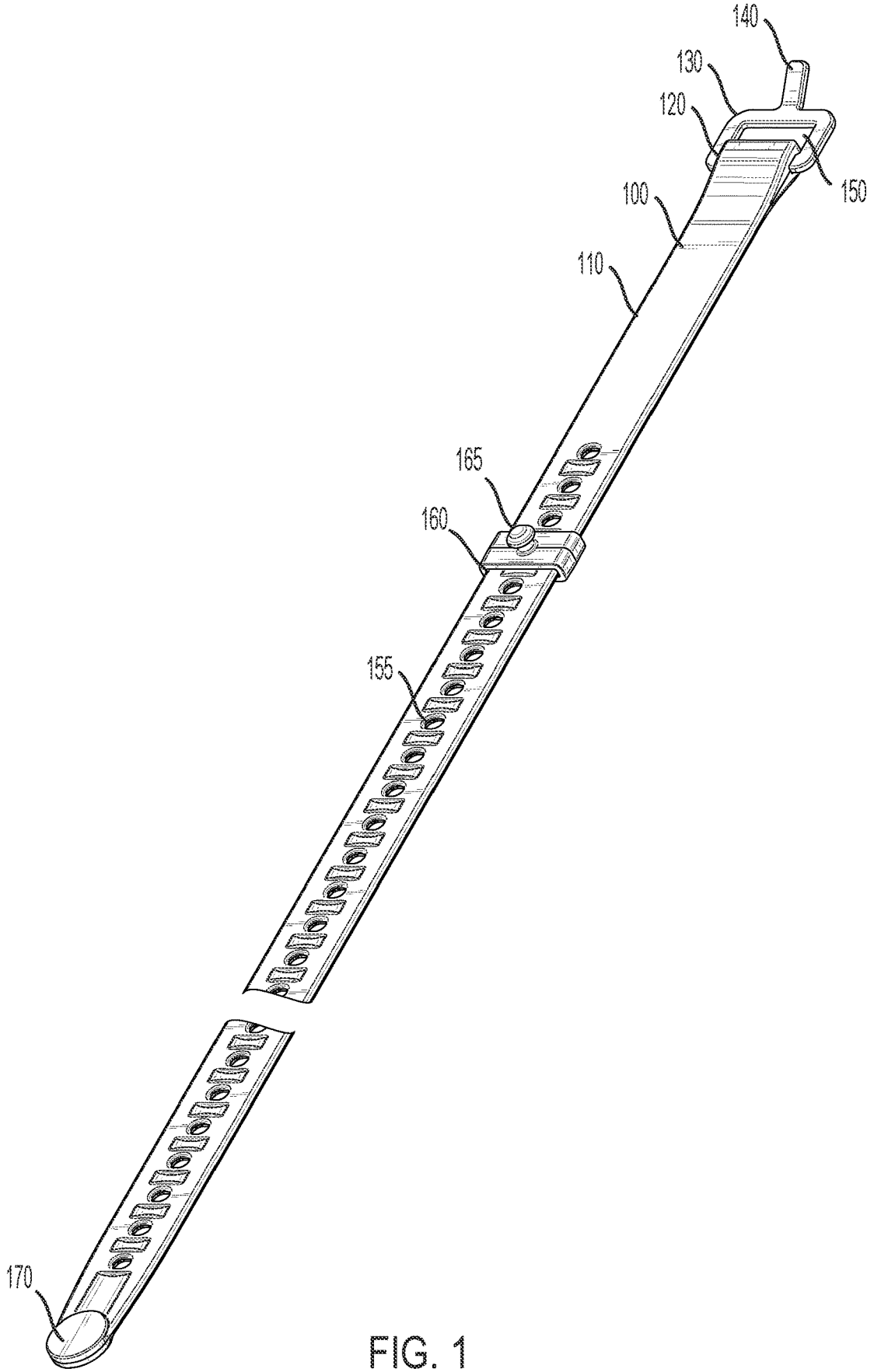
FIG. 1 shows a perspective view of one embodiment of strap system.

FIG. 1 shows one embodiment of a strap system 100. Strap system 100 includes a strap portion 110. Strap portion 110 is generally made of TPU (thermoplastic polyurethane) but may be alternatively composed of a variety of materials, including but not limited to rubbers, plastics, nylon, cloth, etc. Strap portion 110 includes a first end 120. The first end 120 is attached to a buckle 130. The first end 120 is thickened, such that it holds the buckle 130 in line with the strap portion 110. The buckle 130 includes a prong 140 and an aperture 150. Prong 140 is bent towards one side of the buckle 130. The strap portion 110 includes a plurality of apertures 155. These apertures 155 mate with the prong 140 and hold the strap system 100 around an object. Sliding holder 160 is oriented on strap portion 110. Sliding holder 160 includes a protrusion 165 that has a thickened end, such that it can mate with apertures 155 with an interference fit, causing the apertures 155 to flex when the protrusion is pushed through. The sliding holder 160 further includes an end tab 170 to assist in handling of the second end of the strap portion 110 and adding an additional stiffness to the second end, which assists with placing it through aperture 150.

Figure 2:
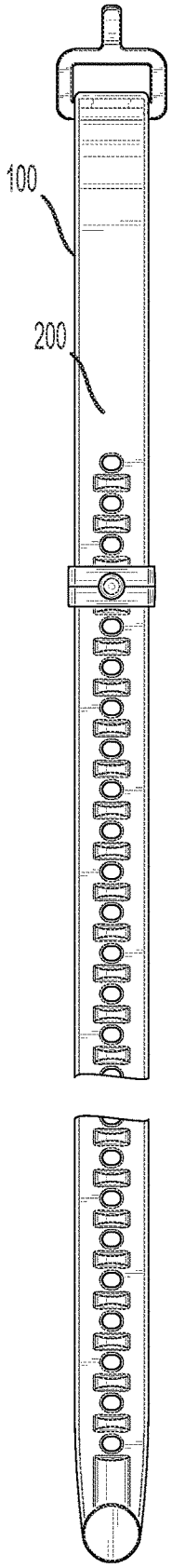
FIG. 2 shows a front view of the strap system of FIG. 1.
Figure 3:
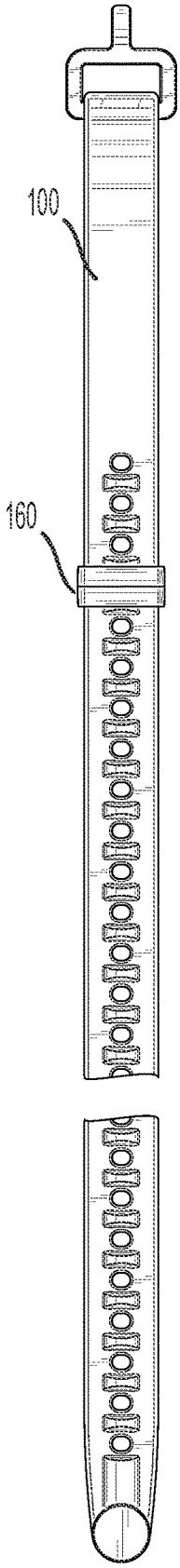
FIG. 3 shows a back view of the strap system of FIG. 1.

FIG. 2 shows another view of strap system 100. Label area 200 may additionally include a label logo or identifying information about the strap and may include the strap length and tension limits or other aspects of the strap (printed into the material). FIG. 3 shows a rear view of strap system 100. As shown in FIG. 3, sliding holder 160 does not include a protrusion 165 on the reverse side. This may additionally help the user in understanding what side to wrap around an object, such that the protrusion 165 side is up.

Figure 4:
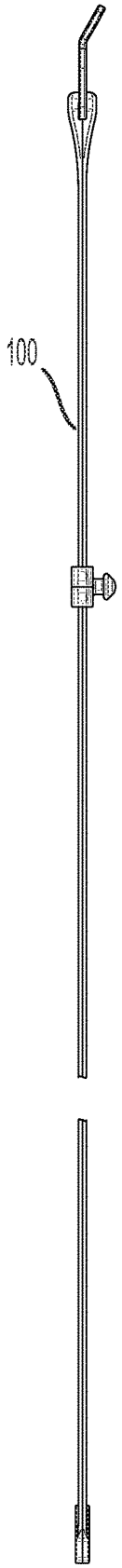
FIG. 4 shows a right side view of the strap system of FIG. 1.
Figure 5:
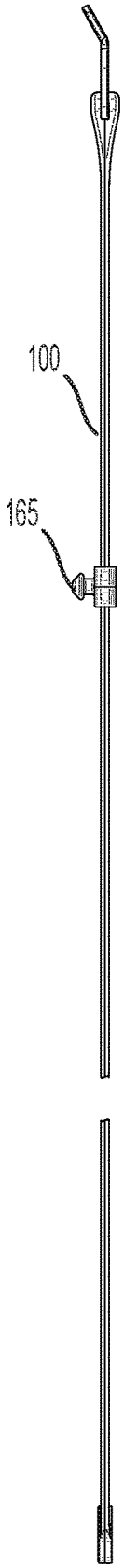
FIG. 5 shows a left side view of the strap system of FIG. 1.
Figure 6:
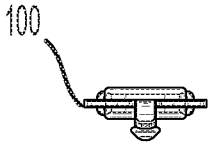
FIG. 6 shows a top view of the strap system of FIG. 1.
Figure 7:
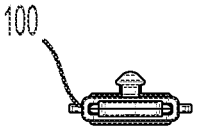
FIG. 7 shows a bottom view of the strap system of FIG. 1.

FIGS. 4 and 5 show side views of the strap system 100. Here the shape of protrusion 165 can be seen, having a somewhat narrowed tip and a widened end such that the interference fit in apertures 155 is achieved. FIGS. 6 and 7 show a top and bottom view of the strap system 100.

Generally, embodiments of the strap system include a strap portion, a buckle, and a sliding holder. Alternative shapes, sizes and lengths are certainly possible. Generally, buckle 130 is made of aluminum, however alternative materials are possible, including but not limited to, other metals, plastics, wood, polymers, resins, and other materials. In many embodiments, some degrees of rigidness for buckle 130 is important, such that tension may be applied to the strap system 100. In operation, strap portion 110 is passed through aperture 150 and bent back such that prong 140 may be secured in an aperture 155. Then, sliding holder is slid along strap portion 110 such that it may mate with an aperture 155 near the end of the loose end of the strap portion.

While specific embodiments have been described in detail in the foregoing detailed description, it will be appreciated by those skilled in the art that various modifications and alternatives to those details could be developed in light of the overall teachings of the disclosure and the broad inventive concepts thereof. It is understood, therefore, that the scope of this disclosure is not limited to the particular examples and implementations disclosed herein but is intended to cover modifications within the spirit and scope thereof as defined by the appended claims and any and all equivalents thereof.

The invention claimed is:

1. A strap system, the strap system comprising:

a strap, the strap including a plurality of apertures;

a buckle, the buckle located at a first end of the strap, the buckle including an aperture and a prong, the prong extending beyond the aperture, the prong sized to fit in each of the plurality of apertures; and a sliding holder, the sliding holder located on the strap, such that the sliding holder slides along the strap, the sliding holder including a projection, the projection extending from the sliding holder, the projection sized to fit into each of the plurality of apertures, the sliding holder slidable along the strap such that the sliding holder mates, via the projection, with a first aperture of the plurality of apertures near an end of a loose end of the strap.

2. The strap system of claim 1, wherein the prong is bent towards a first side in relation to a plane through which the aperture extends.

3. The strap system of claim 2, wherein the strap has a released position where the strap is not secured in the buckle and a holding position where the strap is secured in the buckle by passing a second end of the strap through the aperture and folding the strap back towards the prong and placing the prong through a first one of the plurality of apertures.

4. The strap system of claim 3, wherein the holding position further includes placing the projection through a second one of the plurality of apertures, the second one of the plurality of apertures further towards the second end than the first one of the plurality of apertures.

5. The strap system of claim 4, wherein in the holding position the sliding holder is slid along the strap in order for the second one of the plurality of apertures to line up with the projection.

6. The strap system of claim 5, wherein the projection has a widened tip, such that projection has an interference fit in the second one of the plurality of apertures.

7. The strap system of claim 6, wherein the sliding holder includes a ring with a loop, the loop sized to fit around the strap, such that loop is sized to smoothly slide on the strap.

8. The strap system of claim 7, wherein the buckle is fixed into the first end of the strap, such that a plane maintains an inline position with the first end of the strap.

9. The strap system of claim 8, wherein when in the holding position, when the strap is tensioned tightly around an object, the buckle lays flat on the object.

10. The strap system of claim 9, wherein the strap includes an end tab on the second end of the strap.

11. The strap system of claim 10, wherein the end tab includes a depression configured for ease of gripping by a user.

12. The strap system of claim 11, wherein the strap is made of thermoplastic polyurethane.

13. A strap system, the strap system comprising:

a strap, the strap including a plurality of apertures;

a buckle, the buckle located at a first end of the strap, the buckle including an aperture and a prong, the prong extending beyond the aperture, the prong sized to fit in each of the plurality of apertures;

a sliding holder, the sliding holder located on the strap, such that the sliding holder slides along the strap, the sliding holder including a projection, the projection extending from the sliding holder, the projection sized to fit into each of the plurality of apertures, wherein the strap includes an end tab on a second end of the strap and the end tab includes a depression configured for ease of gripping by a user, the sliding holder slidable along the strap such that the sliding holder mates, via the projection, with a first aperture of the plurality of apertures near an end of a loose end of the strap.

14. The strap system of claim 13, wherein the prong is bent towards a first side in relation to a plane through which the aperture extends, the strap has a released position where the strap is not secured in the buckle and a holding position where the strap is secured in the buckle by passing a second end of the strap through the aperture and folding the strap back towards the prong and placing the prong through a first one of the plurality of apertures, the holding position further includes placing the projection through a second one of the plurality of apertures, the second one of the plurality of apertures further towards the second end than the first one of the plurality of apertures, and in the holding position the sliding holder is slid along the strap in order for the second one of the plurality of apertures to line up with the projection.

15. A method of securing an object, the method comprising:

providing a strap system, the strap system including:

a strap, the strap including a plurality of apertures;

a buckle, the buckle located at a first end of the strap, the buckle including an aperture and a prong, the prong extending beyond the aperture, the prong sized to fit in each of the plurality of apertures; and a sliding holder, the sliding holder located on the strap, such that the sliding holder slides along the strap, the sliding holder including a projection, the projection extending from the sliding holder, the projection sized to fit into each of the plurality of apertures;

wrapping the strap around an object;

running a second end of the strap through the aperture;

pulling the strap tight around the object;

placing the prong in a first one of the plurality of apertures;

sliding the sliding holder along the strap such that the sliding holder is positioned to mate via the projection with a second one of the plurality of apertures near an end of a loose end of the strap placing the projection in the second one of the plurality of apertures.

16. The method of claim 15, further comprising:

sliding the sliding holder along the strap in order to line up with the second one of the plurality or apertures, wherein the second one of the plurality of apertures is near the second end of the strap.

17. The method of claim 16, wherein the prong is bent towards a first side in relation to a plane through which the aperture extends, the strap has a released position where the strap is not secured in the buckle and a holding position where the strap is secured in the buckle by passing a second end of the strap through the aperture and folding the strap back towards the prong and placing the prong through a first one of the plurality of apertures, the holding position further includes placing the projection through a second one of the plurality of apertures, the second one of the plurality of apertures further towards the second end than the first one of the plurality of apertures, and in the holding position the sliding holder is slid along the strap in order for the second one of the plurality of apertures to line up with the projection.

18. The method of claim 17, wherein the projection has a widened tip, such that projection has an interference fit in the second one of the plurality of aperture, the sliding holder includes a ring with a loop, the loop sized to fit around the strap, such that loop is sized to smoothly slide on the strap, and the buckle is fixed into the first end of the strap, such that the plane maintains an inline position with the first end of the strap.

19. The method of claim 18, wherein the strap includes an end tab on the second end of the strap.

20. The method of claim 19, wherein the end tab includes a depression configured for ease of gripping by a user.

* * * * *